US010844617B1

(12) United States Patent
Ahmad et al.

(10) Patent No.: US 10,844,617 B1
(45) Date of Patent: Nov. 24, 2020

(54) SUPPORT BRACE FOR WINDOW FRAMES IN POURED CONCRETE WALLS

(71) Applicant: MONARCH MATERIALS GROUP, INC., Adel, IA (US)

(72) Inventors: Ahmad Ahmad, Des Moines, IA (US); Roelof Jan Siepel, West Des Moines, IA (US)

(73) Assignee: MONARCH MATERIALS GROUP, INC., Adel, IA (US)

( * ) Notice: Subject to any disclaimer, the term of this patent is extended or adjusted under 35 U.S.C. 154(b) by 86 days.

(21) Appl. No.: 16/196,323

(22) Filed: Nov. 20, 2018

Related U.S. Application Data

(60) Provisional application No. 62/589,037, filed on Nov. 21, 2017.

(51) Int. Cl.
*E04G 15/02* (2006.01)
*E04G 21/18* (2006.01)
*E06B 1/36* (2006.01)

(52) U.S. Cl.
CPC ..... *E04G 15/02* (2013.01); *E04G 21/1858* (2013.01); *E06B 1/36* (2013.01)

(58) Field of Classification Search
CPC ..... E04G 15/02; E04G 21/1858; E04G 21/26
(Continued)

(56) References Cited

U.S. PATENT DOCUMENTS 493,566 A * 3/1893 Steedman ..... E04F 21/003 33/194
751,050 A * 2/1904 Bronk ..... E04F 21/003 33/194
(Continued)

FOREIGN PATENT DOCUMENTS

DE 816455 C * 10/1951 ..... E04G 21/1841
FR 1568281 A * 5/1969 ..... E04G 21/1841
(Continued)

*Primary Examiner* — Michael Safavi
(74) *Attorney, Agent, or Firm* — Sturm & Fix LLC

(57) ABSTRACT

A support brace having two complementary sections that are matingly received in the opposite sides of the opening of a window frame to be installed in a poured concrete wall. The two complementary brace sections are secured together to form a bracing structure that is matingly received in the interior opening of a window frame. The width of the support brace is adjustable at a number of selected widths to accommodate window frames of selected widths. Both the inside section of the brace and the outside section of the brace have slotted plates that overlap each other so they can be pinned together to hold the two sections of the support brace at a predetermined and adjustable distance apart corresponding to the width of the window frame being installed. The support brace has both tie slots bars for receiving concrete form ties used with metal forms, and fastener brackets for attachments to wooden forms by nails and screws. Corner gusset strike plates in corners of both sections are used as contact surfaces for separating the inside and outside brace sections from the window frame interior opening after the poured concrete has cured. This facilitates removal from the opening of the window frame. After being removed, the brace sections may be repeatedly reused at other job sites. The reusable support brace provides 100% support on all interior contact surfaces and provides full wall width support. Also, it is adjustable to be able to provide full wall width support for various frame widths.

14 Claims, 9 Drawing Sheets

(58) Field of Classification Search
USPC ..... 249/39; 52/745.15, 745.16, 127.2; 33/194
See application file for complete search history.

(56) References Cited

U.S. PATENT DOCUMENTS 2,515,977 A * 7/1950 Banneyer ..... E04G 15/02 249/39
2,704,876 A * 3/1955 Puckett, Jr. ..... E06B 1/24 249/19
2,748,493 A * 6/1956 Williams ..... E04F 21/0023 33/194
2,787,820 A * 4/1957 Shields ..... E04G 15/02 249/19
2,867,911 A * 1/1959 Atkinson ..... E04F 21/003 33/194
2,914,813 A * 12/1959 Christian ..... E04F 21/0015 52/127.2
3,001,244 A * 9/1961 Kronquist ..... E04F 21/0015 52/127.2
3,065,550 A * 11/1962 Pattiani ..... E04F 21/0015 33/194
3,121,958 A * 2/1964 Findley ..... E04F 21/003 33/194
3,168,305 A * 2/1965 Lee ..... E04F 21/003 269/37
3,199,206 A * 8/1965 Snapp ..... E04F 21/0015 33/194
3,293,764 A * 12/1966 Born ..... E04F 21/003 33/194
3,403,486 A * 10/1968 Schubeis ..... E04F 21/0015 52/127.2
3,408,744 A * 11/1968 Fitzgerald ..... E04F 21/003 33/194
3,995,843 A * 12/1976 Kasteler ..... E04G 15/02 269/47
4,138,084 A * 2/1979 Reid ..... E04G 15/02 249/177
4,189,520 A * 2/1980 Gauchel ..... B29C 48/30 428/520
4,430,831 A 2/1984 Kemp
4,829,727 A * 5/1989 Kuzara, Jr. ..... E04F 21/0015 248/351
5,253,839 A * 10/1993 McClure ..... E04G 15/02 248/354.1
5,496,213 A * 3/1996 Miller ..... E04B 1/7076 249/39
5,671,583 A * 9/1997 Turner ..... E04F 13/06 52/745.15
6,810,592 B1 * 11/2004 Oldfield, Jr. ..... E04F 21/0015 33/194
RE43,251 E 3/2012 Anderson et al.
8,651,450 B2 2/2014 Sollars
2002/0069541 A1 * 6/2002 Sumner ..... E04F 21/0015 33/194
2004/0000061 A1 * 1/2004 Tuthill ..... E04F 21/0015 33/194
2009/0293409 A1 * 12/2009 Capece ..... E06B 3/26341 52/656.2
2010/0251635 A1 * 10/2010 Barnard ..... E06B 3/485 52/127.6
2011/0120034 A1 * 5/2011 Melkonian ..... B29C 48/0012 52/204.5
2018/0371225 A1 * 12/2018 Strand ..... C08L 27/06

FOREIGN PATENT DOCUMENTS

FR 2201695 A5 * 4/1974 ..... E04G 21/1841
FR 2855843 A1 * 12/2004 ..... E04G 15/02

* cited by examiner

SUPPORT BRACE FOR WINDOW FRAMES IN POURED CONCRETE WALLS

CROSS REFERENCE TO RELATED APPLICATIONS

This Non-Provisional U.S. patent application claims priority from U.S. Provisional Application, Ser. No. 62/589,037 filed Nov. 21, 2017, entitled Reusable Steel Brace for Vinyl Pour-in-Place Windows.

BACKGROUND OF INVENTION

Field of the Invention

This invention relates generally to concrete form accessories, and more particularly to a reusable support brace for window frames set in poured concrete walls.

Description of the Related Art

When basement windows are to be included in poured concrete walls, the window frame is placed directly inside panels or forms, either aluminum or wood, that are part of the wall forming system. Concrete is poured into the top of the forms and flows around the window frame, thus permanently installing the frame in the wall. Steel window frames are stronger and more rigid than vinyl frames. Steel frames (or steel bucks where a full window, either steel or vinyl, including the frame and sash are installed after the pour) are typically supported at certain pressure points during a concrete pour. Because of its rigidity and ability to withstand pressure, the steel buck does not need to be fully braced through full interior surface contact (all the way around the interior). Steel bucks also do not need full wall-width support for the same reason. Vinyl window frames on the other hand are a more flexible and softer material and will bend under pressure.

Due to the stress and weight of the concrete on the frame, particularly vinyl frames, the frame tends to deform and even collapse unless bracing is provided to withstand the pressure.

The prevalent industry practice is to brace vinyl window frames with dimensional lumber and/or structural sheets, like OSB or plywood, while the concrete walls of a building are being poured. The wood bracing is generally installed by the frame manufacturer. After the walls have been poured the bracing material is removed by the contractor and discarded, contributing to jobsite waste.

Accordingly, there is a need for a more efficient and cleaner environmental solution for this process.

BRIEF SUMMARY OF THE INVENTION

The present invention provides a support brace having two complementary sections that are matingly received in the opposite sides of the opening of a window frame to be installed in a poured concrete wall. The two complementary brace sections are secured together to form a bracing structure in the interior opening of a window frame. The width of the support brace is adjustable at a number of selected widths to accommodate window frames of selected widths. Both the inside section of the brace and the outside section of the brace have slotted plates that overlap each other so they can be pinned together to hold the two sections of the support brace at a predetermined and adjustable distance apart corresponding to the width of the window frame being installed. The support brace has both tie slots bars for receiving concrete form ties used with metal forms, and fastener brackets for attachments to wooden forms by nails and screws. Corner gusset strike plates in corners of both sections are used as contact surfaces for separating the inside and outside brace sections from the window frame interior opening after the poured concrete has cured. This facilitates removal from the opening of the window frame. After being removed, the brace sections may be repeatedly reused at other job sites. The reusable support brace provides 100% support on all interior contact surfaces and provides full wall width support. Also, it is adjustable to be able to provide full wall width support for various frame widths.

BRIEF DESCRIPTION OF THE DRAWINGS

These and other attributes of the invention will become more clear upon a thorough study of the following description of the best mode for carrying out the invention, particularly when reviewed in conjunction with the drawings wherein.

DETAILED DESCRIPTION OF THE INVENTION

Figure 1:
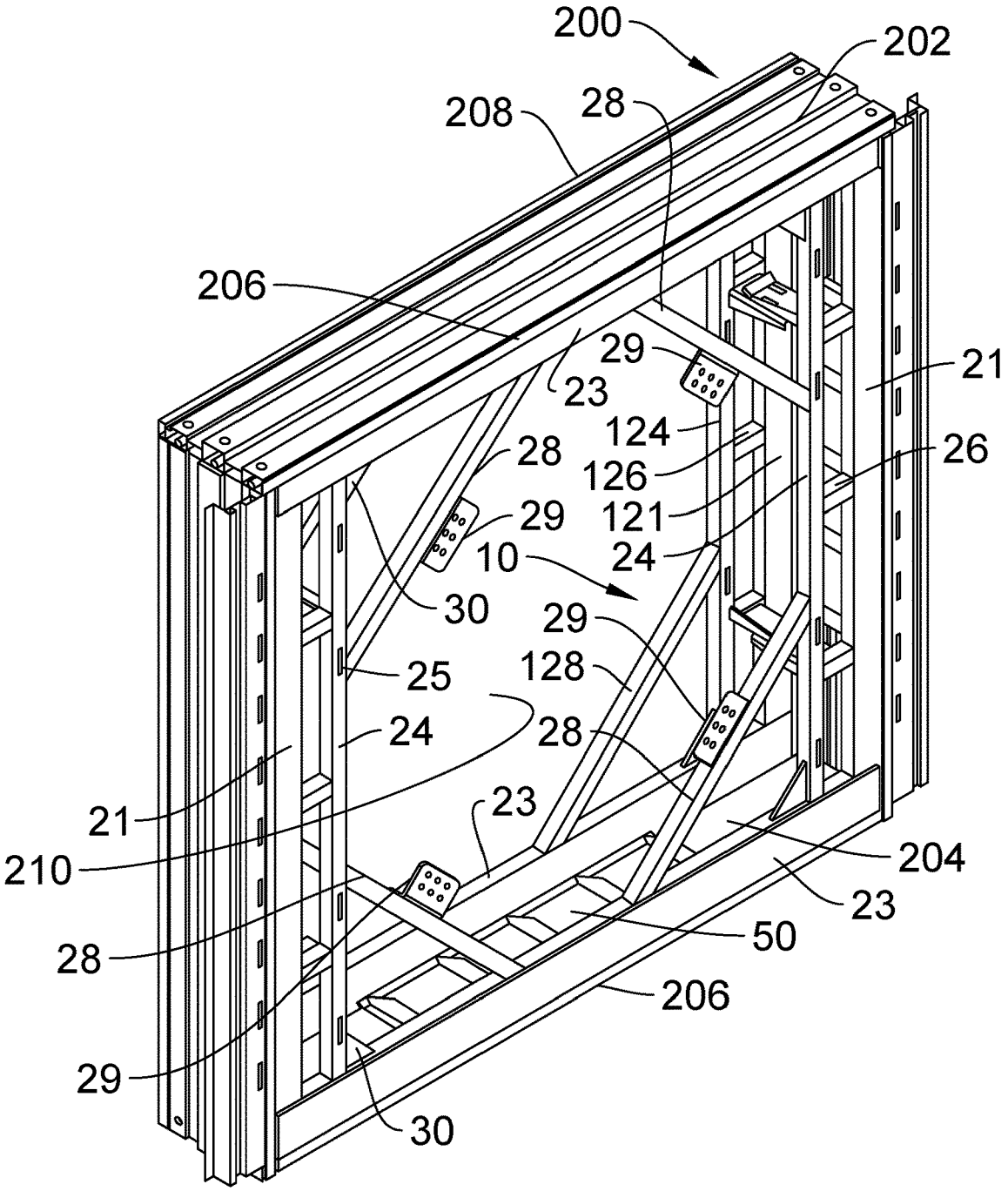
FIG. 1 is a perspective view illustrating the support brace of the present invention installed in the central opening of a window frame as it is used in conjunction with concrete form panels for a poured concrete wall.
Figure 2:
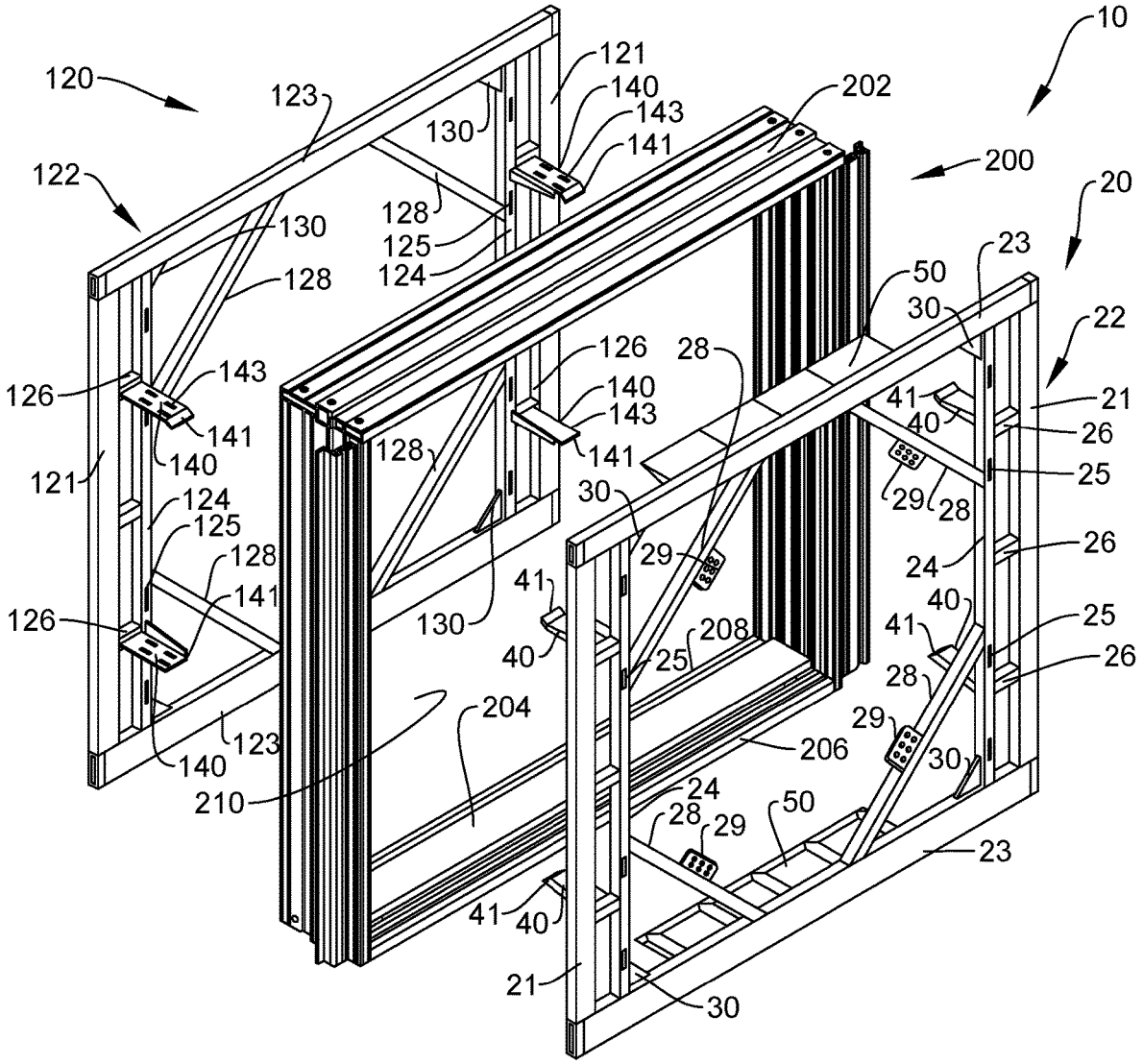
FIG. 2 is an exploded perspective view showing the outside brace section and the inside brace section positioned to be matingly received in the central opening of the window frame.
Figure 3:
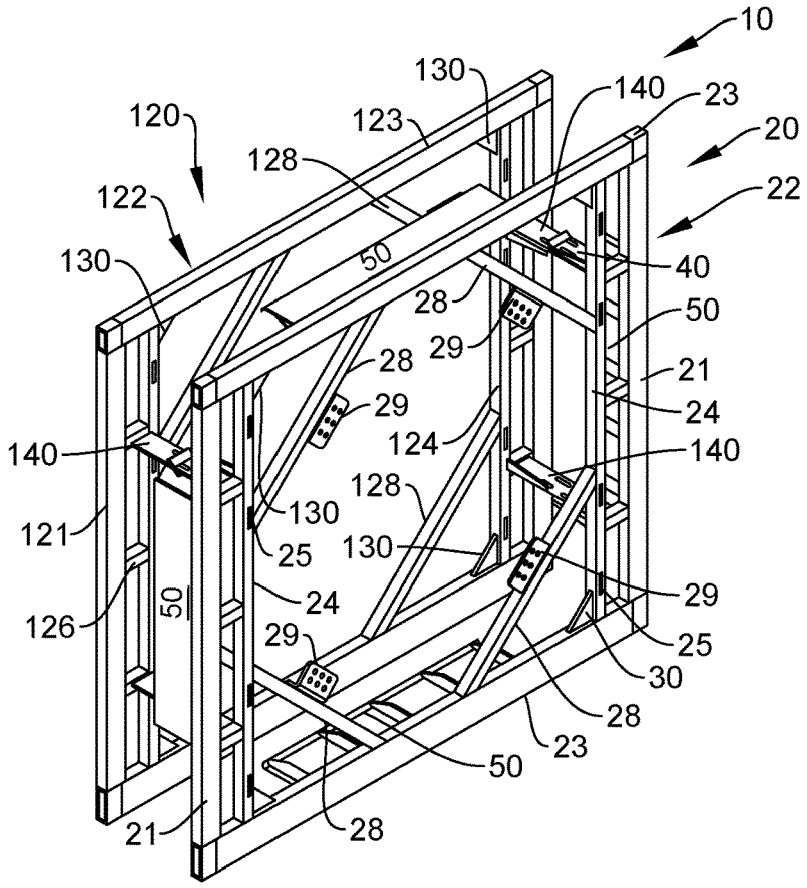
FIG. 3 is an exploded perspective view showing the outside and inside brace sections in the position where they first contact each other.

As can be seen by reference to the drawings, and particularly to FIGS. 1 and 2, the support brace that forms the basis of the present invention is designed generally by reference number 10. The support brace 10 includes a pair of complementary sections, comprising on outside brace section 20 and an inside brace section 120.

The outside brace section 20 consists of a rectangular outer frame 22 having vertical concrete tie slot bars 24 spaced in from and connected to the vertical members 21 of the frame 22 by stub connectors 26. The tie slot bars 24 have a number of slots 25 formed through them to receive concrete form ties 200 for attachment to metal forms. Diagonal struts 28 interconnect the horizontal members 23 of the frame 22 and the tie slot bars 24. Wood form fastener brackets 29 are attached to and extend inward flush with the outer surface of the diagonal struts 28. The fastener brackets 29 have openings for receiving nails or screws for attachment to wooden forms.

Corner gusset strike plates 30 are attached at each of the interior junctions of the horizontal frame members 23 and the tie slot bars 24. Slotted plates 40, having canted distal ends 41, are attached to and extend in from the top and bottom stub connectors 26 on each side of the frame 22. Openings 43 in the plates 40 are sized to receive a wedge bolt 44. Central support plates 50 are attached to and extend in from the horizontal frame member 21, and may also be attached to and extended in from the vertical frame members 23.

The inside brace section 120 is substantially identical to the outside brace section 20, except the inside brace section 120 does not include the fastener brackets 29 or the central support plates 50. Also, the canted distal ends 41 of the slotted plates 40 of the outside brace section 20 extend in opposite directions from the corresponding components of the inside brace section 120. The equivalent components of the inside brace section 120 include the outer frame 122 with vertical and horizontal members 121 and 123, concrete tie slot bars 124 with slots 125, stub connectors 126, diagonal struts 128, corner gusset plates 130, and slotted plates 140 having canted distal ends 141 and openings 143.

The support brace 10 provides support against deformation of a pour-in-place window frame 200. The support brace 10 may be used with window frames 200 made of any suitable material, but the support brace 10 is preferably used with vinyl window frames 200. Also, the window frame 200 could be for various window types, but the typical frame 200 is for a basement egress window required by building codes and paired with an egress well with an attached ladder or steps for easy escape.

The window frame 200 has an exterior peripheral surface 202 disposed to contact the poured concrete, an internal peripheral surface 204 that defines a central opening 210, an outside edge 206, and an inside edge 208.

As best shown in FIGS. 1 and 2, the outside brace section 20 is matingly received in the central opening 210 from the outside edge 206 so that the outer face of the frame 22 is flush with the outside edge 206 of the window frame 200. To complete the installation of the support brace 10, the inside brace section 120 is matingly received in the central opening 210 from the inside edge 208 so that the inner face of the frame 122 is flush with the inside edge 208 of the window frame 200. When the outside and inside brace sections 20 and 120 are in these fully advanced positions, the slotted plates 40 of the outside brace section 20, and the slotted plates 140 of the inside brace section 120 overlap.

Figure 4:
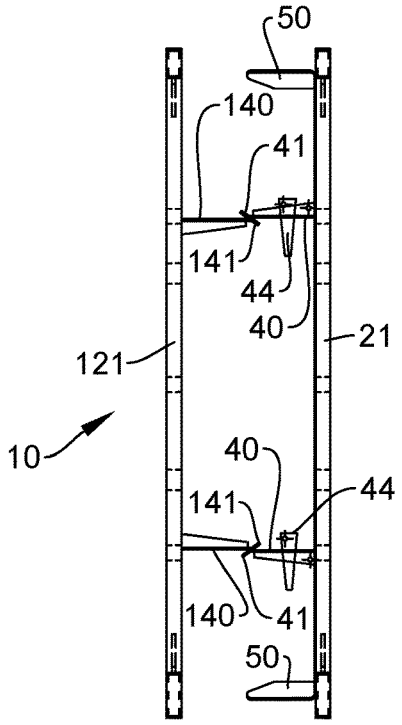
FIG. 4 is a side elevation sectional view thereof.
Figure 5:
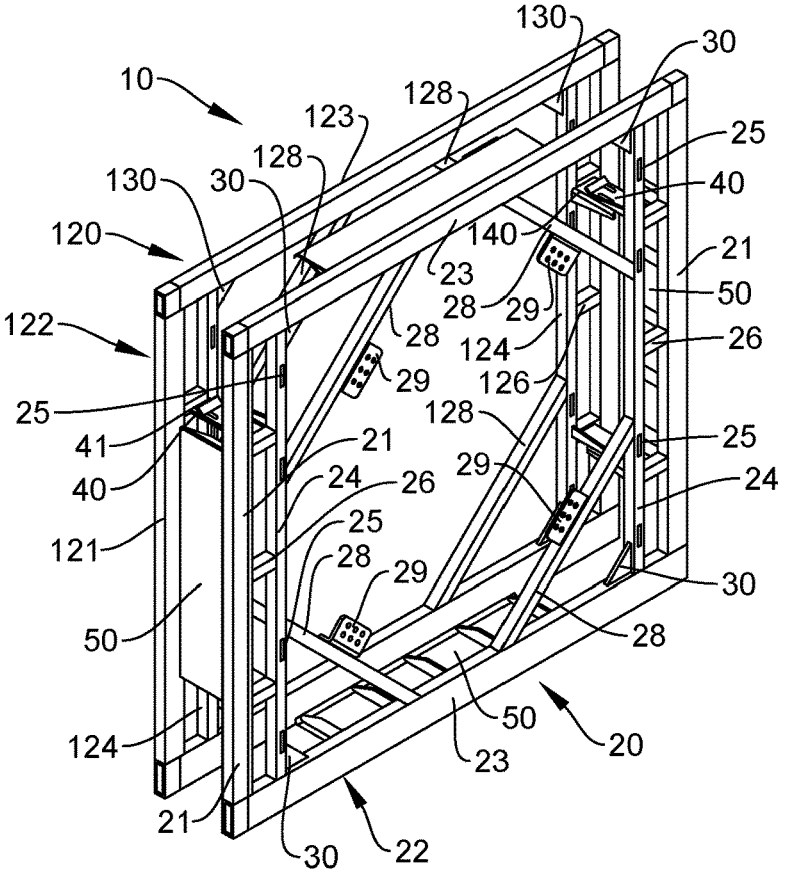
FIG. 5 is a perspective view showing the outside and inside brace sections in an engaged position where they can be locked together in the central opening of the window frame.
Figure 6:
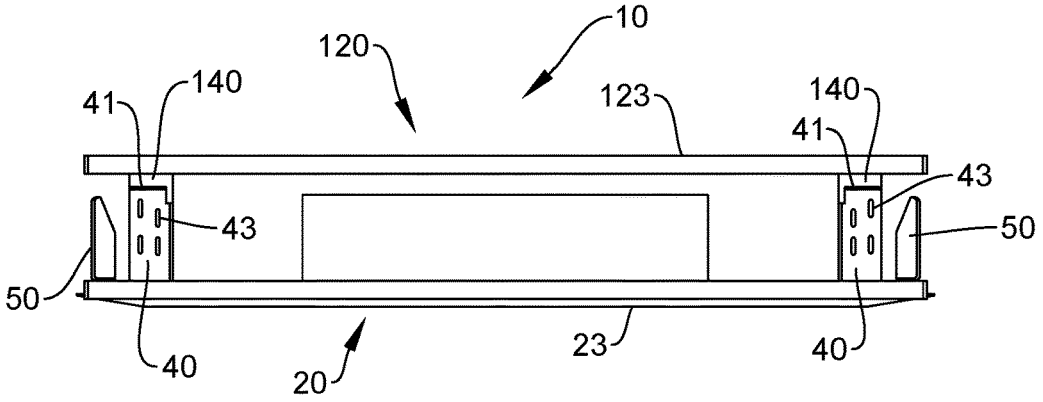
FIG. 6 is a top plan view thereof.
Figure 7:
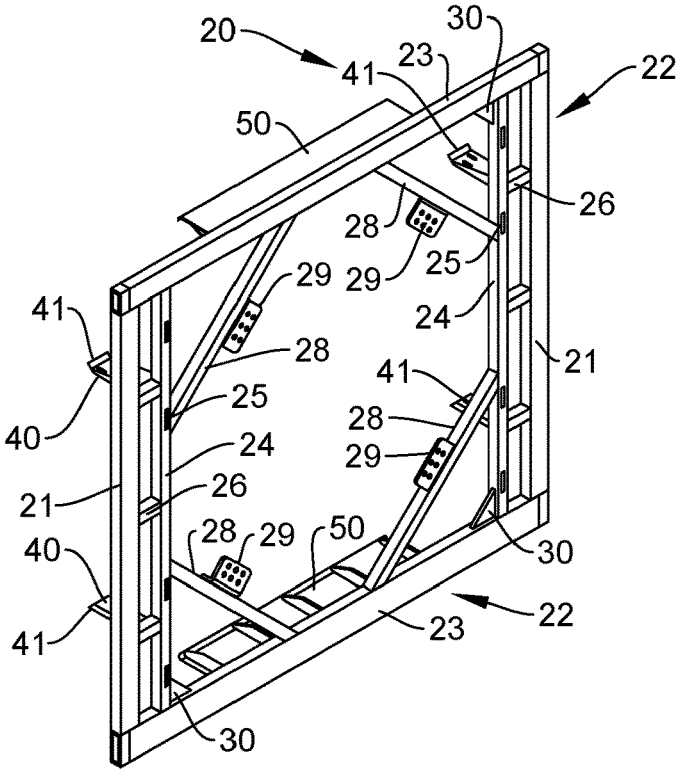
FIG. 7 is a perspective view of the outer face of the outside brace section.
Figure 8:
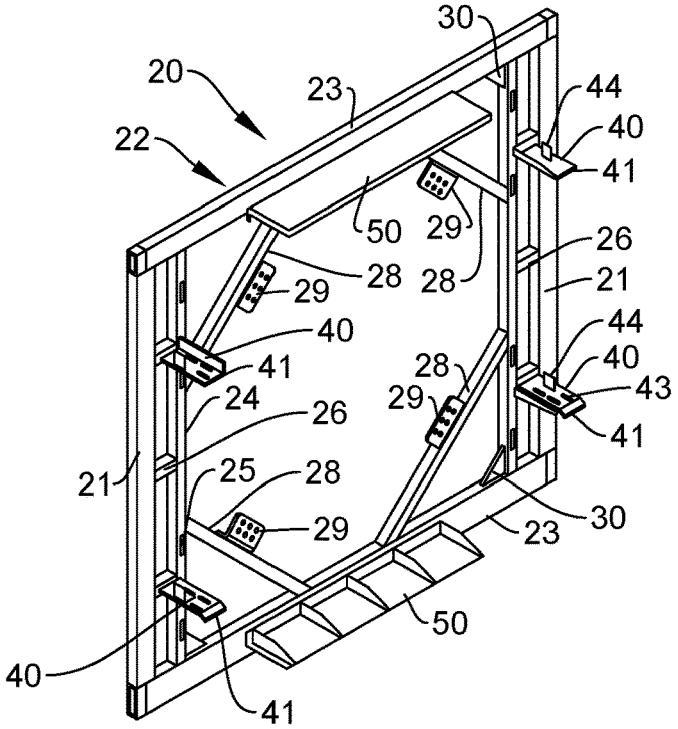
FIG. 8 is a perspective view of the inner face of the outside brace section.
Figure 9:
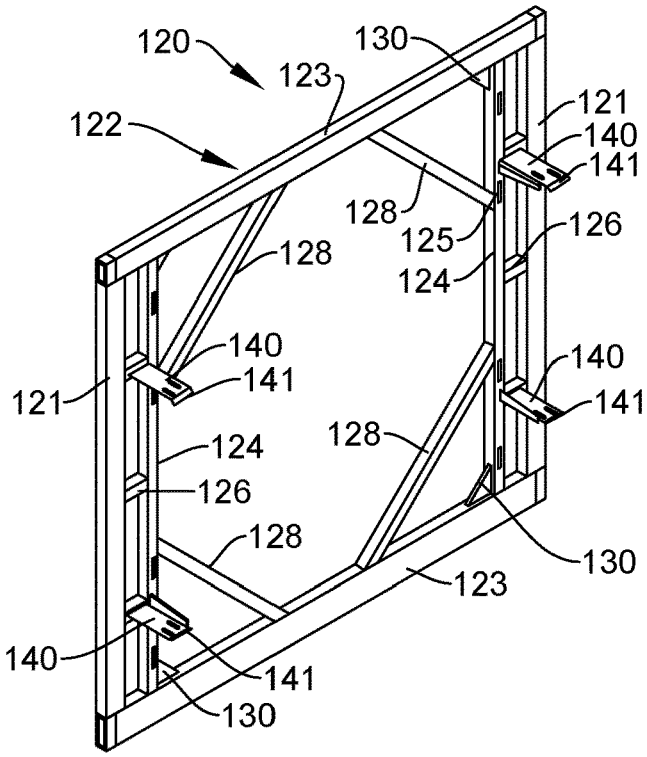
FIG. 9 is a perspective view of the outer face of the inside brace section.
Figure 10:
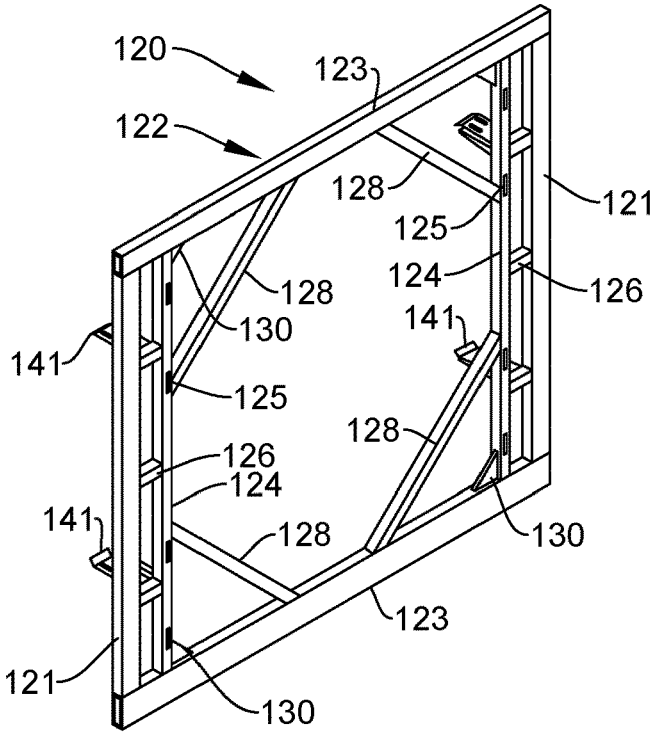
FIG. 10 is a perspective view of the inner face of the inside brace section.
Figure 11A:
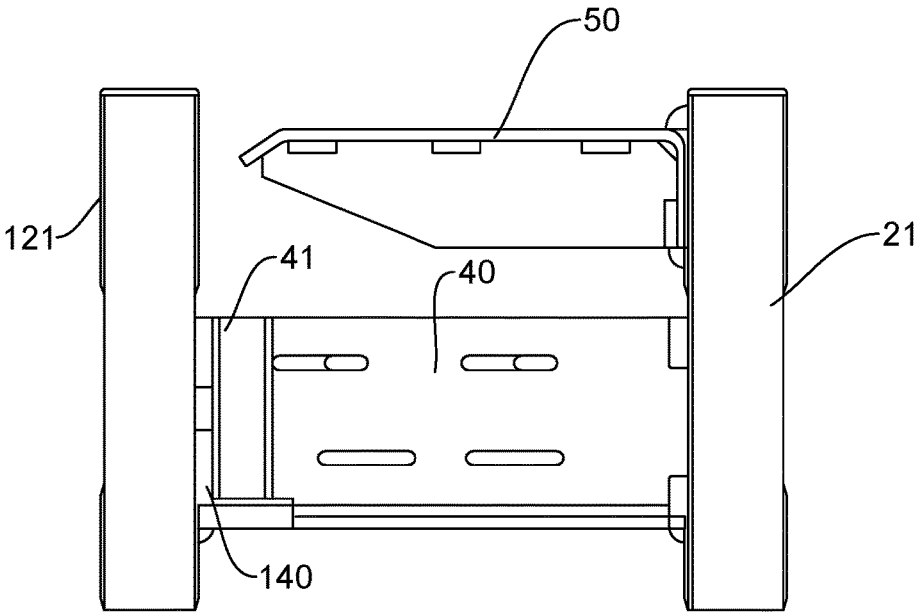
FIG. 11A is a partial top plan view showing the slotted plates overlapped at a first distance that provides a first predetermined spacing at a first support brace width.
Figure 11B:
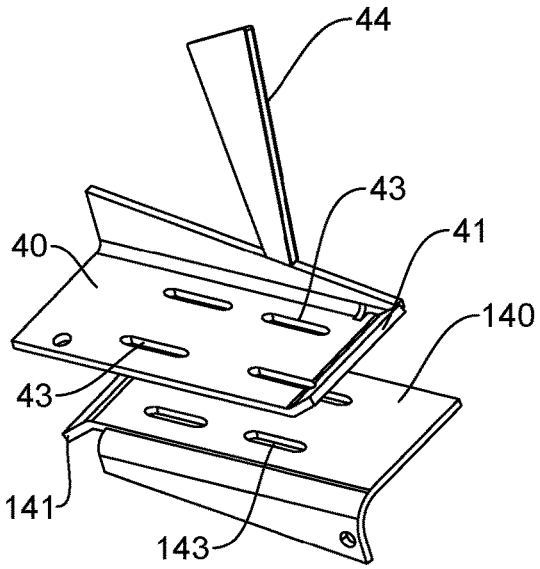
FIG. 11B is a partial exploded perspective view showing the slotted plates overlapped at a first distance and positioned to receive a wedge bolt through a registered pair of overlapped openings.
Figure 11C:
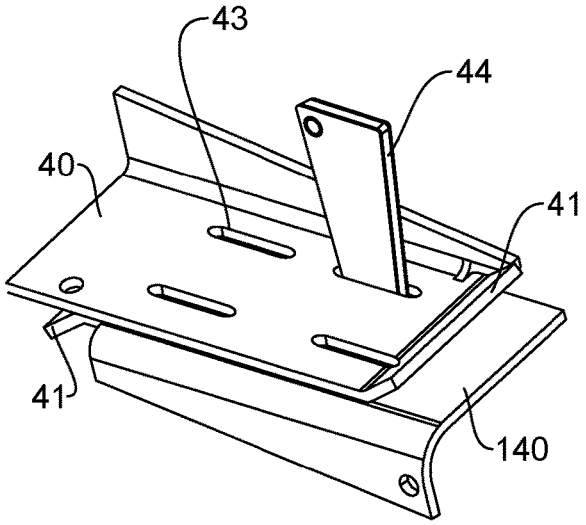
FIG. 11C is a partial perspective view showing the wedge bolt inserted to lock the outside and inside brace sections together at a first support brace width.
Figure 12A:
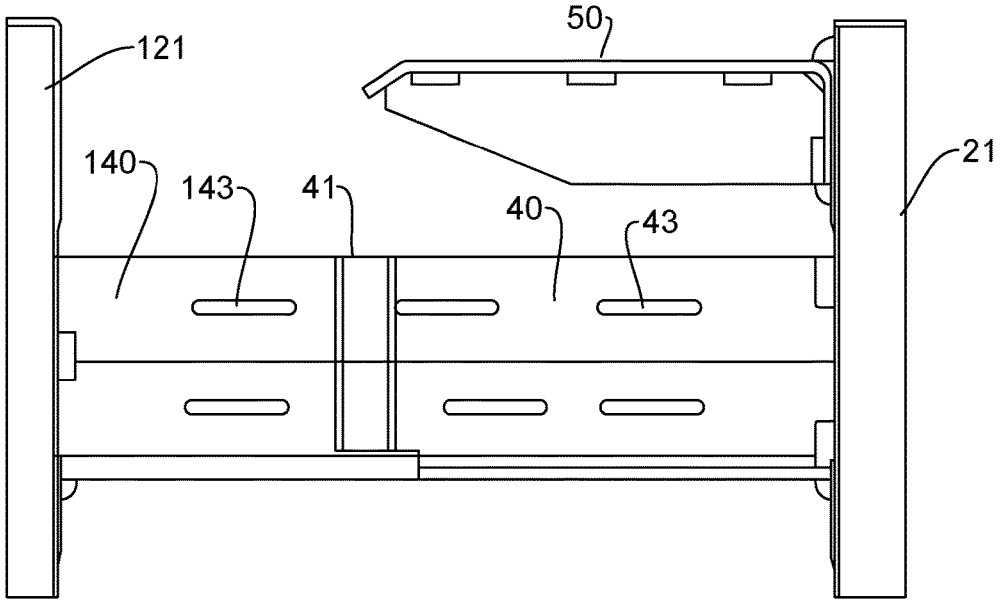
FIG. 12A is a partial top plan similar to FIG. 11A, but showing the slotted plates overlapped at a second distance giving a second support brace width.
Figure 12B:
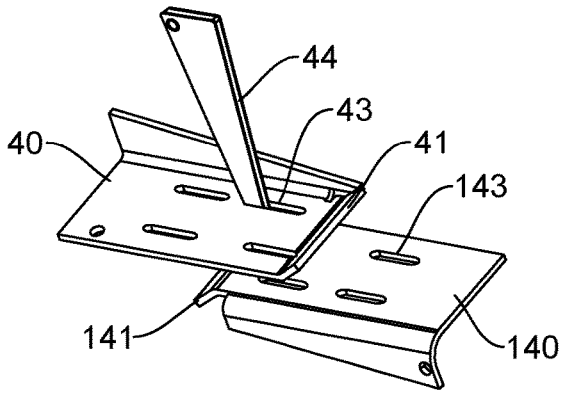
FIG. 12B is a partial exploded perspective view similar to FIG. 11B, but showing the overlapping at a second distance.
Figure 12C:
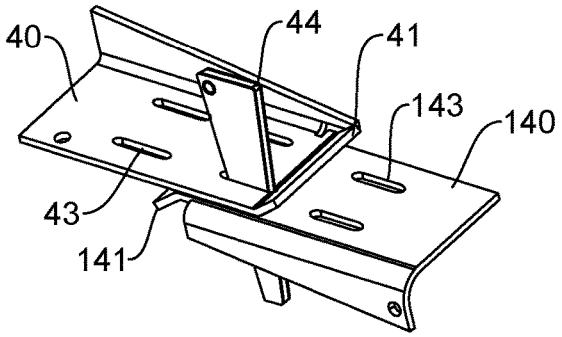
FIG. 12C is a partial perspective view showing the outside and inside brace sections locked together at a second support brace width.
Figure 13:
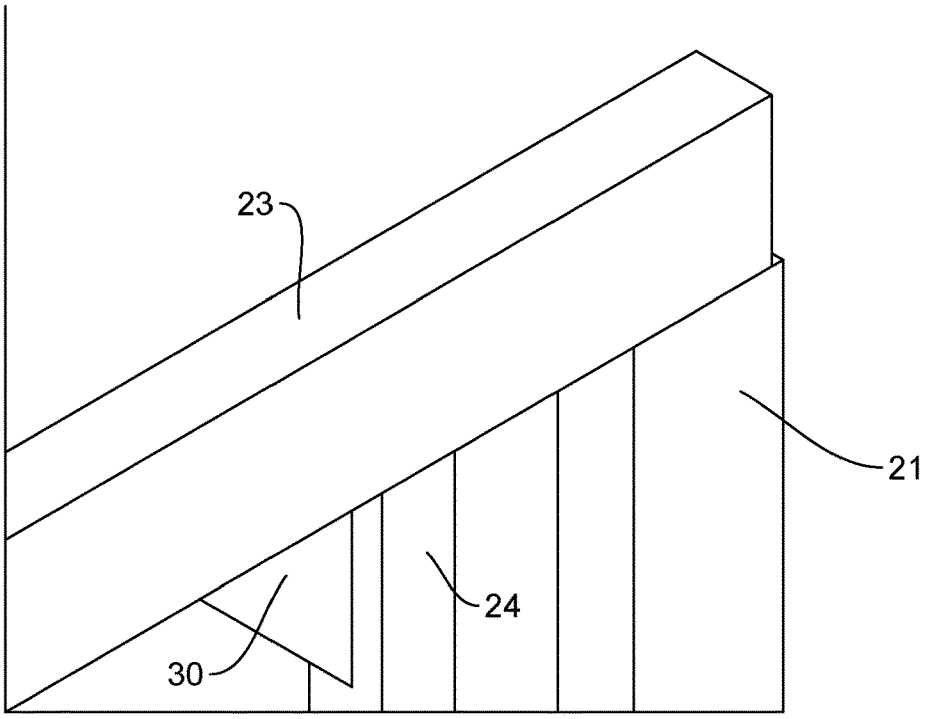
FIG. 13 is a partial perspective view showing the location of the corner gusset strike plate.
Figure 14:
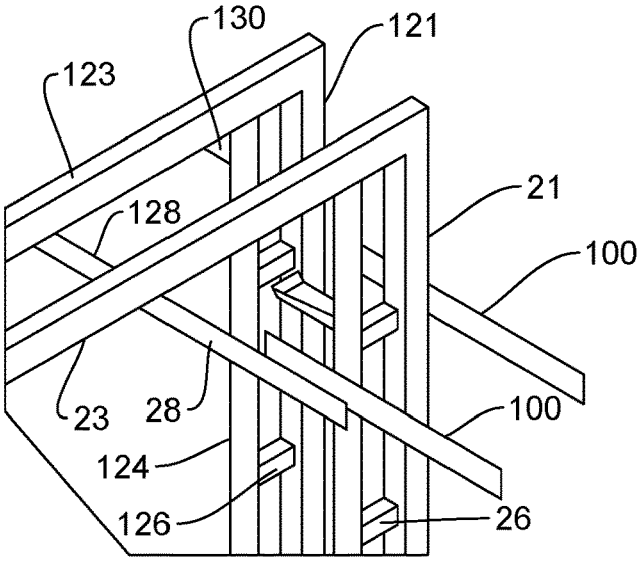
FIG. 14 is a partial perspective view illustrating concrete form ties being inserted through registered openings in the form tie bars of the outside and inside brace sections.

Referring now to FIGS. 11A through 12C, the distance of the overlap of the overlapping slotted plates 40 and 140 varies depending on the desired width of the support brace 10 that corresponds to the width of the poured concrete wall and the window frame 200. FIG. 4 illustrates that the canted ends 41 and 141 of slotted plates 40 and 140 act to guide the slotted plates 40 and 140 as the outside and inside brace sections 20 and 120 are fully advanced in the central opening 210 of the window frame 200. FIGS. 11A through 11C show the support brace 10 configured to have the narrowest of the illustrated desired widths, where the slotted plates 40 and 140 are overlapped to the greatest extent, and the wedge bolt 44 is inserted through registered openings 43 and 143 to lock the outside and inside brace sections 20 and 120 together. FIGS. 12A through 12C showed the support brace 10 configured to have the widest of the illustrated desired widths. It is to be understood that numerous desired widths are possible. When installed in the central opening 210 of a window frame 200, the support brace 10 prevents the deformation of the frame 200 that is subjected to the forces exerted by the weight of the poured concrete. When the concrete is cured, and the wall forms are removed, the support frame 10 may be removed from the window frame 200, by removing the form ties 200, removing the wedge bolts 44, and removing the outside and inside brace sections 20 and 120. A hammer may be used to strike the corner gusset strike plates 30 and 130 to dislodge excess concrete and facilitate the removal of the outside and inside brace sections 20 and 120 for reuse.

Vinyl windows are generally preferred over windows having steel frames. Vinyl frames improve thermal efficiency and stop unwanted condensation, which is prevalent with steel frames. Condensation can result in drywall damage and black mold.

The support brace of the present invention reduces the overall cost of vinyl windows since the frames may be shipped without the typical wood bracing. This reduces the shipping weight and reduces the cost of shipping. Further, job site waste and the cost of waste disposal is reduced, since the typical wood bracing is eliminated.

Also, the support brace of the present invention may be reused multiple times, and it is conveniently adjustable to a broad range of standard wall widths, including widths of 7 5/16", 8", 9", 9 5/16" and 10". Another advantage is the reusable support brace allows installation of full wall width frames that extend across the entire wall width.

Those skilled in the art will recognize that a wide variety of modifications, alterations, in combinations can be made with respect to the above described embodiments without departing from the spirit and scope of the invention, and that such modifications, alterations, and combinations are to be viewed as being within the ambit of the inventive concept.

The invention claimed is:

1. A support system for a pour-in-place window frame, the support system comprising:

a polyvinyl chloride window frame having an exterior peripheral surface disposed to contact poured concrete, an interior peripheral surface defining a central opening, an outside edge, and an inside edge a support brace including a pair of complementary sections including an outside brace section and an inside brace section, the outside brace section being disposed to be matingly received in the central opening from the outside edge of the window frame, and the inside brace section being disposed to be matingly received in the central opening from the inside edge of the window frame, a locking mechanism disposed to hold the outside brace section and the inside brace section together at a predetermined spacing defining a width of the support brace;

an outside face of the outside brace section is disposed flush with the outside edge of the window frame;

an inside face of the inside brace section is disposed to flush with the inside edge of the window frame;

wherein the locking mechanism includes:

an outside plate having an opening, the outside plate being attached to the outside section and disposed to extend into the central opening of the window frame, an inside plate having an opening, the inside plate being attached to the inside brace section and disposed to extend into the central opening of the window frame to overlap the inside plate a predetermined distance, such that the opening of the outside plate and the opening of the inside plate are aligned; and a bolt disposed to extend through the aligned openings, thereby locking the outside brace section and the inside brace section at a predetermined distance apart, that defines the support brace width.

2. The support system of claim 1, wherein:

the outside plate has a plurality of slotted openings; and the inside plate has plurality of slotted openings;

wherein the outside plate and the inside plate are disposed to overlap at a plurality of predetermined distances such that at least one of the plurality of slotted openings in the outside plate is aligned with at least one of the plurality of openings in the inside plate; and a wedge bolt disposed to extend through the aligned openings, thereby locking the outside brace section and the inside brace section at one of the plurality of predetermined distances apart that defines one of a plurality of support brace widths.

3. The support system of claim 1, wherein:

the outside plate has a canted distal end directed in a first direction; and the inside plate has a canted distal end directed in a second direction opposite from the first direction.

4. The support system of claim 1, wherein:

the outside brace section includes an outside tie slot bar having an opening; and the inside brace section includes an inside tie slot bar having an opening, wherein the opening in the outside tie slot bar and the opening in the inside tie slot bar are horizontally aligned and disposed to receive a concrete form tie.

5. The support system of claim 1, wherein the outside brace section includes a fastener bracket having an opening disposed to receive a concrete form fastener, the fastener bracket being disposed flush with the outside face of the outside brace section.

6. The support system of claim 1, further including:

a first corner gusset strike plate disposed on the outside brace section; and a second corner gusset strike plate disposed on the inside brace section.

7. A support brace for a pour-in-place window frame having an exterior peripheral surface disposed to contact poured concrete, an interior peripheral surface defining a central opening, an outside edge, and an inside edge, the support brace comprising:

a pair of complementary sections including an outside brace section and an inside brace section, the outside brace section being disposed to be matingly received in the central opening from the outside edge of the window frame, and the inside brace section being disposed to be matingly received in the central opening from the inside edge of the window frame, and a locking mechanism disposed to hold the outside brace section and the inside brace section together at a predetermined spacing defining a width of the support brace;

an outside face of the outside brace section is disposed flush with the outside edge of the window frame; and an inside face of the inside brace section is disposed to flush with the inside edge of the window frame;

wherein the locking mechanism includes:

an outside plate having an opening, the outside plate being attached to the outside section and disposed to extend into the central opening of the window frame, an inside plate having an opening, the inside plate being attached to the inside brace section and disposed to extend into the central opening of the window frame to overlap the inside plate a predetermined distance, such that the opening of the outside plate and the opening of the inside plate are aligned; and a bolt disposed to extend through the aligned openings, thereby locking the outside brace section and the inside brace section at a predetermined distance apart, that defines the support brace width.

8. The support brace of claim 7, wherein:

the outside plate has a plurality of slotted openings; and the inside plate has plurality of slotted openings;

wherein the outside plate and the inside plate are disposed to overlap at a plurality of predetermined distances such that at least one of the plurality of slotted openings in the outside plate is aligned with at least one of the plurality of openings in the inside plate; and a wedge bolt disposed to extend through the aligned openings, thereby locking the outside brace section and the inside brace section at one of the plurality of predetermined distances apart that defines one of a plurality of support brace widths.

9. The support brace of claim 7, wherein:

the outside plate has a canted distal end directed in a first direction; and the inside plate has a canted distal end directed in a second direction opposite from the first direction.

10. The support brace of claim 7, wherein:

the outside brace section includes an outside tie slot bar having an opening; and the inside brace section includes an inside tie slot bar having and opening, wherein the opening in the outside tie slot bar and the opening in the inside tie slot bar are horizontally aligned and disposed to receive a concrete form tie.

11. The support brace of claim 7, wherein the outside brace section includes a fastener bracket having an opening disposed to receive a concrete form fastener, the fastener bracket being disposed flush with the outside face of the outside brace section.

12. The support brace of claim 7, further including:

a first corner gusset strike plate disposed on the outside brace section; and a second corner gusset strike plate disposed on the inside brace section.

13. The support brace of claim 7, wherein the window frame is formed of a synthetic plastic.

14. The support brace of claim 13 wherein the synthetic plastic is polyvinyl chloride.

* * * * *